US011685179B2

(12) United States Patent
Malo

(10) Patent No.: US 11,685,179 B2
(45) Date of Patent: Jun. 27, 2023

(54) OLFACTORY SENSORY BOOK

(71) Applicant: Kurtis Edward Malo, Kamloops (CA)

(72) Inventor: Kurtis Edward Malo, Kamloops (CA)

( * ) Notice: Subject to any disclaimer, the term of this patent is extended or adjusted under 35 U.S.C. 154(b) by 0 days.

(21) Appl. No.: 17/449,101

(22) Filed: Sep. 28, 2021

(65) Prior Publication Data

US 2023/0101800 A1 Mar. 30, 2023

(51) Int. Cl.

| | |
|---|---|
| ***B42D 3/12*** | (2006.01) |
| ***C11B 9/00*** | (2006.01) |
| ***C11D 3/50*** | (2006.01) |

(52) U.S. Cl.

CPC ..... *B42D 3/12* (2013.01); *C11B 9/00* (2013.01); *C11D 3/50* (2013.01)

(58) Field of Classification Search

CPC ..... B42D 3/12

See application file for complete search history.

(56) References Cited

U.S. PATENT DOCUMENTS

2001/0035644 A1* 11/2001 Amadeo ..... B42D 1/007 281/31

FOREIGN PATENT DOCUMENTS

| | | | | |
|---|---|---|---|---|
| JP | 2000118178 A | * | 4/2000 | |
| KR | 880003688 Y1 | * | 10/1988 | |
| KR | 890003521 Y1 | * | 5/1989 | |
| KR | 890003522 Y1 | * | 5/1989 | |
| KR | 20100040770 A | * | 4/2010 | |
| KR | 200476327 Y1 | * | 2/2015 | |
| WO | WO-2009157619 A1 | * | 12/2009 | ..... B42F 13/00 |

OTHER PUBLICATIONS

KR880003688Y1 English Translation (Year: 1988).*
JP-2000118178-A English Translation (Year: 2000).*
KR200476327Y1 English Translation (Year: 2015).*
KR20100040770A English Translation (Year: 2010).*

* cited by examiner

*Primary Examiner* — Kyle R Grabowski
(74) *Attorney, Agent, or Firm* — Orin Del Vecchio

(57) ABSTRACT

An olfactory sensory book that is operable to provide an olfactory stimulation that correlates to portions of the content of the book. The invention includes at least one perimeter panel wherein the perimeter panel has formed therein a plurality of scent compartments. The scent compartments have an opening wherein the opening is sealably secured with a removable cap member. The scent compartments include an interior volume wherein disposed within the interior volume is an absorbent material. The absorbent material is operable to be saturated with a volatile compound. Removal of the cap member during use of the book of the invention provides release of the fragrance of the volatile compound saturated on the absorbent material. The scent compartment is further configured with a slot and a screen member wherein the slot facilitates release of the fragrance. A rear access panel provides access to the interior volume of the scent compartment.

12 Claims, 2 Drawing Sheets

OLFACTORY SENSORY BOOK

FIELD OF THE INVENTION

The present invention relates generally to children's books, more specifically but not by way of limitation, a children's book that is configured to provide a plurality of olfactory associations with various parts of the story that is written in the book.

BACKGROUND

Millions of people regularly read to their children. Reading to children is not only an opportunity to bond with a child but it is widely known that reading to young children assists in the mental development and growth of the child. Children's books are quite popular and are widely available. Reading sessions can not only occur in the home by a caregiver but are typically part of a formal educational curriculum as well. Reading groups are often performed in elementary school classes and provide an opportunity for children to further be exposed to reading and the mental development it provides.

There are children's books that provide alternate sensory devices as part of the book in order to create an improved experience and further enhance the learning of the child. Many studies have shown that adding items to book that teach parameters such as tactile sensations or other similar parameters enhance the ability for a child to retain the learned parameter. Associations of sensory input in conjunction with reading not only provides a more enjoyable engaging experience for the child and the reader, it has been shown to enhance the ability for a child to learn. While existing books do provide accessories that focus on parameters such as tactile sensory and audio association by way of music, no children's books provide an olfactory experience to accompany the story of the book.

Accordingly, there is a need for a children's book that includes the ability to provide a plurality of olfactory senses to a child during utilization of the book wherein the olfactory senses are associated with the story of the book.

SUMMARY OF THE INVENTION

It is the object of the present invention to provide a children's book that is operable to provide a plurality of olfactory senses that are associated with different parts of the story of the book wherein the present invention includes a body.

Another object of the present invention is to provide a children's book configured to provide a multitude of scents wherein the scents are associated with elements of the story of the book wherein the body of the present invention includes a front cover member and a rear cover member.

A further object of the present invention is to provide a children's book that is operable to provide a plurality of olfactory senses that are associated with different parts of the story of the book wherein the rear cover member includes a perimeter panel.

Still another object of the present invention is to provide a children's book configured to provide a multitude of scents wherein the scents are associated with elements of the story of the book wherein the perimeter panel includes a plurality of scent compartments.

An additional object of the present invention is to provide a children's book that is operable to provide a plurality of olfactory senses that are associated with different parts of the story of the book wherein the scent compartments have an interior volume.

Yet a further object of the present invention is to provide a children's book configured to provide a multitude of scents wherein the scents are associated with elements of the story of the book wherein the scent compartments include a releasably secured cap member.

Another object of the present invention is to provide a children's book that is operable to provide a plurality of olfactory senses that are associated with different parts of the story of the book wherein the scent compartments include a rear access panel.

An alternate object of the present invention is to provide a children's book configured to provide a multitude of scents wherein the scents are associated with elements of the story of the book wherein the scent compartments include an absorbent material disposed in the interior volume thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
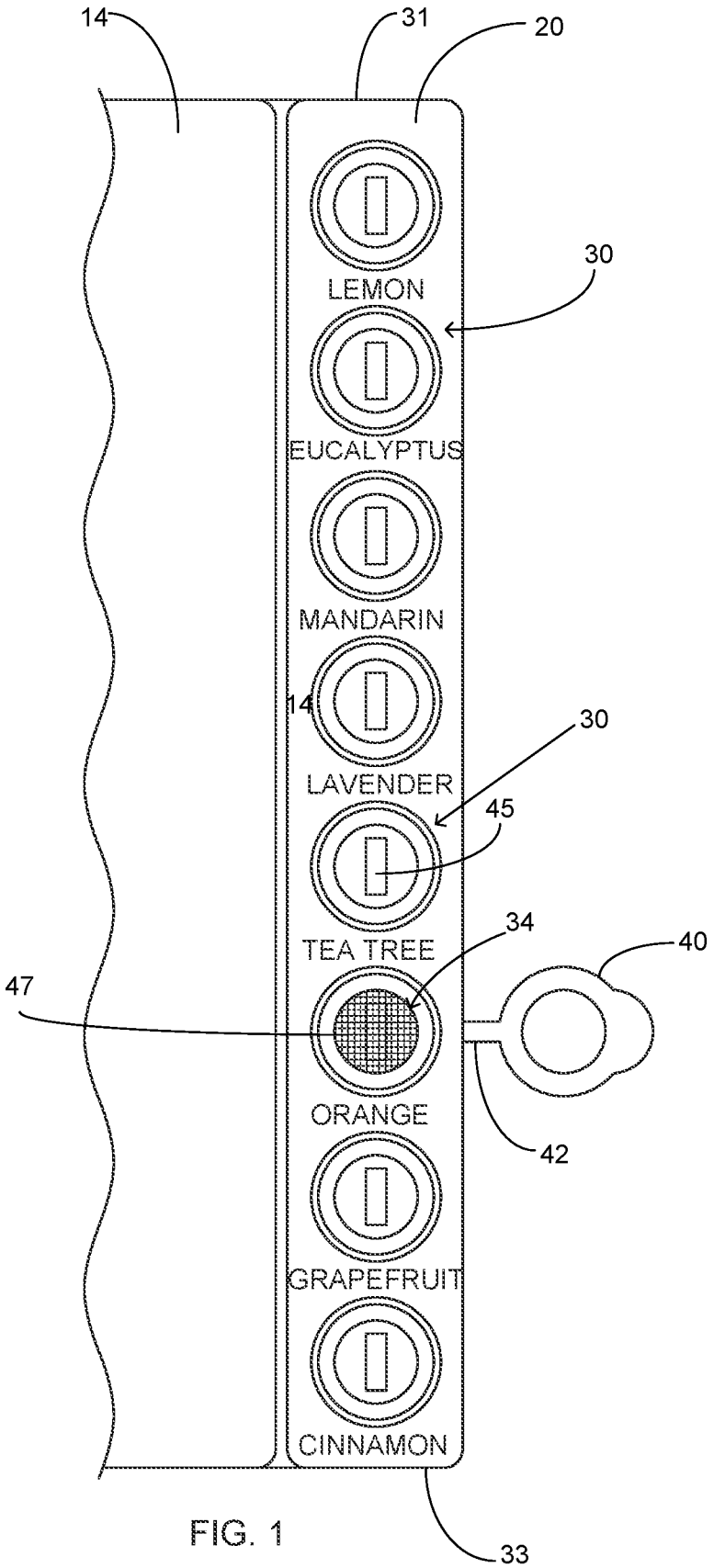
FIG. 1 is a front view of the perimeter panel with a cutaway view of the body of the present invention.
Figure 2:
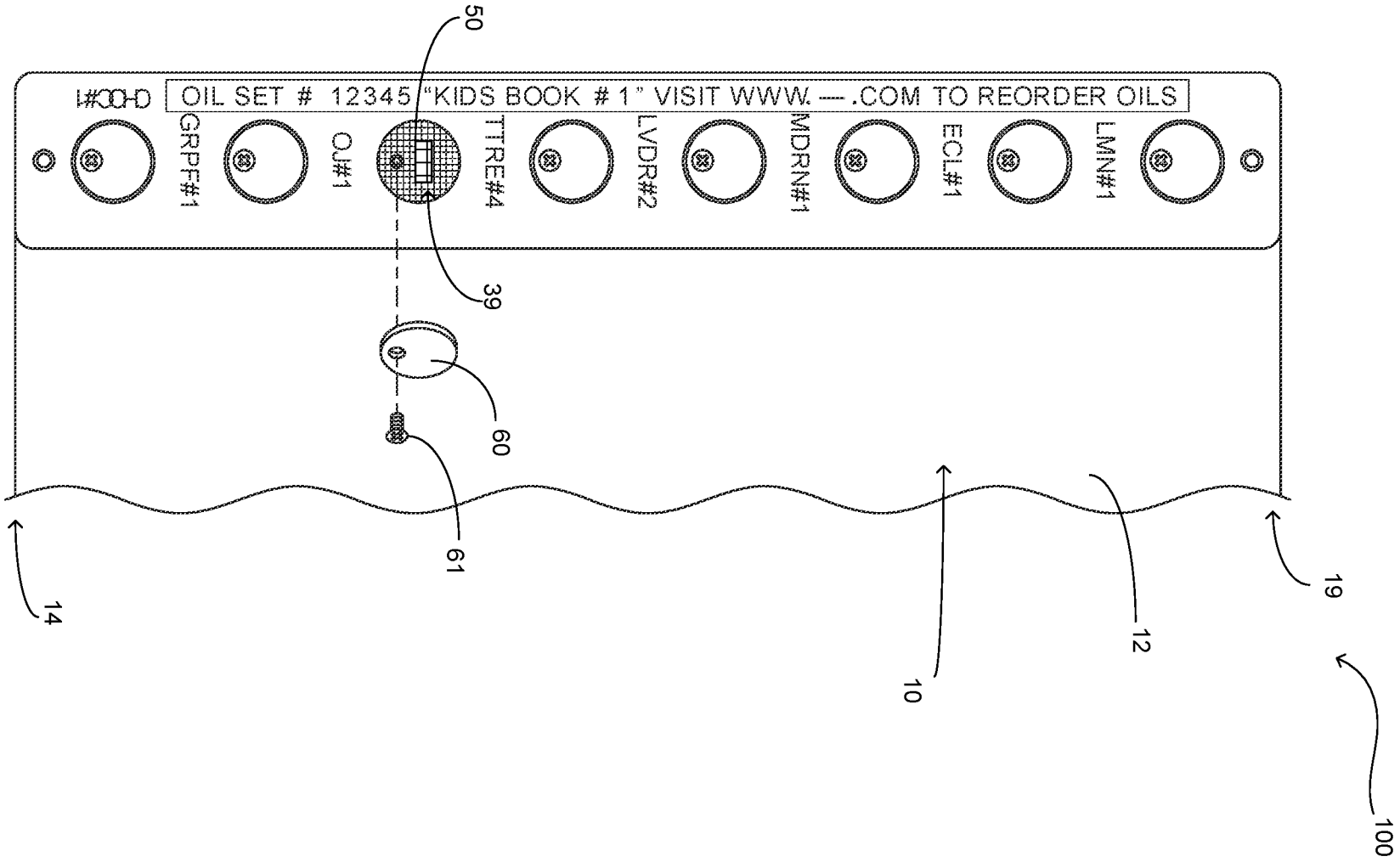
FIG. 2 is a rear view of the perimeter panel and a portion of the rear cover member of the present invention.

Referring now to the drawings submitted herewith, wherein various elements depicted therein are not necessarily drawn to scale and wherein through the views and figures like elements are referenced with identical reference numerals, there is illustrated an olfactory sensory book 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the"

include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring to the Figures submitted as a part hereof, the olfactory sensory book 100 includes a body 10 wherein the body 10 includes a conventional rear cover member 12 and front cover (not illustrated herein) having bound pages 14 therebetween. It should be understood within the scope of the present invention that the drawings submitted as a part hereof illustrated only a portion of the book of the present invention so as to provide improved visibility of the novel elements of the olfactory sensory book 100. The olfactory sensory book 100 is constructed as a conventional book with pages bound between covers and includes the novel elements discussed herein after.

The rear cover member 12 includes a perimeter panel 20. The perimeter panel 20 extends intermediate the lower end 17 and upper end 19 of the rear cover member 12. The perimeter panel 20 extends laterally outward from the rear cover member 12 and is contiguously formed therewith utilizing suitable techniques. While no particular material is required for the perimeter panel 20, it is contemplated within the scope of the present invention that the perimeter panel 20 be manufactured from a lightweight rigid material such as but not limited to plastic. While the perimeter panel 20 is illustrated as being laterally present along the rear cover member 12, it is contemplated within the scope of the present invention that more than one perimeter panel 20 could be contiguously formed on the body 10 in alternate locations. By way of example but not limitation, the body 10 could have perimeter panels 20 on any edge thereof.

Formed in the perimeter panel 20 are a plurality of scent compartments 30. The scent compartments 30 are arranged in a linear manner from the top edge 31 to the bottom edge 33 of the perimeter panel 20. While the scent compartments 30 are illustrated as being annular herein, it should be understood within the scope of the present invention that the scent compartments 30 could be provided in alternate shapes and sizes. The scent compartments 30 include opening 34. Opening 34 is covered by a removable cap member 40, wherein the cap member 40 is secured to the perimeter panel 20 via keeper 42. The keeper 42 and cap member 40 are manufactured from a suitable material such as but not limited to plastic or rubber. The opening 34 further includes a slot 45 and screen member 47. Slot 45 provides access to the interior volume 39 of the scent compartment 30. Disposed within the interior volume 39 of the scent compartment 30 is absorbent material 50. The screen member 47 is superposed the slot 45 across the opening 34 to ensure the secure positioning of the absorbent material. It is contemplated within the scope of the present invention that the scent compartment 30 could be provided without the screen member 47 and further have slots 45 that are alternate sizes and shapes. Furthermore, it is contemplated within the scope of the present invention that the slot 45 could be exchanged with a plurality of small apertures.

The absorbent material 50 is saturated with a volatile compound such as but not limited to an oil or fragrance. It is intended within the scope of the present invention to provide a plurality of fragrances wherein the fragrances are intended to be experienced during reading the content of the olfactory sensory book 100. When at a certain point of the content of the olfactory sensory book 100, a user will remove the cap member 40 so as to allow a fragrance to egress from the scent compartment 30. As the user progresses through the content of the olfactory sensory book 100, each of the cap members 40 are removed and replaced so as to provide an olfactory experience and association with different parts of the content of the olfactory sensory book 100. It should be understood within the scope of the present invention that numerous types of fragrances could be provided within the scent compartments 30.

The scent compartments 30 include rear access panel 60 releasably secured with fastener 61. The rear access panel 60 provides access to the interior volume 39 in order to retrieve the absorbent material 50. It is intended within the scope of the present invention that the rear access panel 60 provides access to the absorbent material to facilitate replacement thereof or provide an ability to deposit additional volatile compounds thereon.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An olfactory sensory book that is operable to provide olfactory stimulation during reading of content of the book wherein the olfactory sensory book comprises:

a body, said body having a front cover and a rear cover, said body having a plurality of pages;

at least one perimeter panel, said at least one perimeter panel being disposed on an edge of said body and being contiguous therewith, said at least one perimeter panel extending outward from said body;

a plurality of scent compartments, said plurality of scent compartments being formed in said at least one perimeter panel, said plurality of scent compartments having an interior volume, the interior volume comprising a replaceable scented material, said plurality of scent compartments configured to provide an olfactory stimulation to a user of the olfactory sensory book, wherein each replaceable scented material has a scent which is associated with one or more sections of the content of the olfactory sensory book and wherein the content of the olfactory sensor book further comprises an indication to the user as to which scent compartment to use.

2. The olfactory sensory book as recited in claim 1, [and further including] wherein the replaceable scented material comprises an absorbent material, [said absorbent material being disposed in the interior volume of said plurality of scent compartments,] said absorbent material saturated with a volatile scented compound.

3. The olfactory sensory book as recited in claim 2, wherein said plurality of scent compartments further include an opening on a front side thereof, said opening further having at least one aperture formed therein.

4. The olfactory sensory book as recited in claim 3, and further including a cap member, said cap member being removably secured to said opening of said plurality of scent compartments, said cap member operable to sealably close said plurality of scent compartments.

5. The olfactory sensory book as recited in claim 4, and further including a screen member, said screen member disposed across said opening of said plurality of scent compartments, said screen member operable to cover said at least one aperture.

6. The olfactory sensory book as recited in claim 5, wherein said plurality of scent compartments further include a rear access panel, said rear access panel being releasably secured so as to provide access to said interior volume.

7. The olfactory sensory book as recited in claim 6, wherein said plurality of scent compartments are annular in shape.

8. A book configured to provide an olfactory stimulation to correspond with alternate portions of the book wherein the book comprises:

a body, said body having a front cover and a rear cover, said body having a plurality of pages;

a perimeter panel, said perimeter panel being disposed on a lateral edge of said rear cover and being contiguous therewith, said perimeter panel extending laterally outward from said body;

a plurality of scent compartments, said plurality of scent compartments being formed in said at least one perimeter panel, said plurality of scent compartments having an interior volume, the interior volume comprising a replaceable scented material, said plurality of scent compartments configured in a linear manner intermediate an upper edge and a lower edge of the perimeter panel, said plurality of scent compartments having an opening, said opening having a slot formed therein, said opening further having a screen member disposed thereacross; and a cap member releasably secured to each of said openings of said plurality of scent compartments and configured to be removed during utilization of the book so as to provide release of a fragrance, wherein each replaceable scented material has a scent which is associated with one or more sections of the alternate portions of the olfactory sensory book and wherein the alternate portions of the olfactory sensor book further comprise an indication to the user as to which scent compartment to use.

9. The book configured to provide an olfactory stimulation to correspond with alternate portions of the book as recited in claim 8, and further including an absorbent material, said absorbent material being disposed in the interior volume of said plurality of scent compartments, said absorbent material configured to be saturated with a volatile compound.

10. The book configured to provide an olfactory stimulation to correspond with alternate portions of the book as recited in claim 9, wherein said plurality of scent compartments further include a rear access panel, said rear access panel being releasably secured so as to provide access to said interior volume.

11. The book configured to provide an olfactory stimulation to correspond with alternate portions of the book as recited in claim 10, wherein said slot is rectangular in form.

12. The book configured to provide an olfactory stimulation to correspond with alternate portions of the book as recited in claim 11, wherein said plurality of scent compartments are annular in shape.

* * * * *